US006679091B2

(12) United States Patent
Yamada et al.

(10) Patent No.: US 6,679,091 B2
(45) Date of Patent: Jan. 20, 2004

(54) STRETCH BENDER

(75) Inventors: Takayuki Yamada, Seto (JP); Teruaki Yogo, Seto (JP)

(73) Assignee: Kabushiki Kaisha Opton, Seto (JP)

( * ) Notice: Subject to any disclaimer, the term of this patent is extended or adjusted under 35 U.S.C. 154(b) by 39 days.

(21) Appl. No.: 10/153,190

(22) Filed: May 21, 2002

(65) Prior Publication Data

US 2002/0174701 A1 Nov. 28, 2002

(30) Foreign Application Priority Data

May 23, 2001 (JP) ..... 2001-153947

(51) Int. Cl.[7] ..... B21D 11/02

(52) U.S. Cl. ..... 72/296; 72/20.1; 72/31.11; 72/302

(58) Field of Search ..... 72/14.8, 15.3, 72/16.2, 17.3, 17.2, 20.1, 20.2, 31.11, 296, 297, 302

(56) References Cited

U.S. PATENT DOCUMENTS 2,446,089 A 7/1948 Hochreiter ..... 153/48
3,948,071 A * 4/1976 Lieberman et al. ..... 72/20.1
4,459,838 A * 7/1984 Kutz et al. ..... 72/302
4,803,878 A 2/1989 Moroney ..... 72/296
5,086,636 A * 2/1992 Huet ..... 72/296
6,018,970 A * 2/2000 Ford et al. ..... 72/21.5

FOREIGN PATENT DOCUMENTS

JP 09285822 11/1997 ..... B21D/11/02

* cited by examiner

*Primary Examiner*—Ed Tolan
(74) *Attorney, Agent, or Firm*—Davis & Bujold, PLLC

(57) ABSTRACT

A stretch bending device that can conduct accurate bending without using heavy material. A tension application mechanism 62 comprises first and second drive sources for movably supporting both ends of a guide member 12 with respect to a pair of arm members 28, 30 and moving the guide member 12 along the arm members 28, 30. Between the arm members 28, 30, a work piece 6 is arranged. There are tension sensor 98 for detecting tension applied to the work piece 6 and position sensors for detecting positions of the guide member 12. Torque of the first drive source is controlled based on the tension detected by the tension sensor 98, and the second drive force is controlled based on the positions detected by the position sensors.

8 Claims, 11 Drawing Sheets

STRETCH BENDER

FIELD OF THE INVENTION

This invention relates to a stretch bender for bending a strip work piece by thrusting it against a bending die while applying axial tension to the work piece.

BACKGROUND OF THE INVENTION

When a window frame for an automobile is formed, a steel strip is rolled, cut and bent into a desired shape. In order to form a work piece into a three-dimensional shape which is fitted to the outer shape of the window, a stretch bender for three-dimensional bending is required.

Schematic constitution of such a stretch bender is illustrated in FIGS. 11A and 11B. The stretch bender 400 comprises a base 410, curved rails 420 mounted on the base 410, arms 440 which rotatively move on the curved rails 420 around support shafts 430 provided on the base 410, pillars 450 movably standing on the arms 440, lifts 460 which can be moved upward and downward guided by the pillars 460, and chuck mechanisms 470 provided on the lifts 460 for gripping a strip work piece. In stretch bending, the chuck mechanisms 470 grip both ends of the strip work piece 480, and while tension is applied to the work piece 480 to its axial direction, the work piece 480 is thrust against the bending die 490. The bending die 490 has a groove for bending, and the work piece 480 is formed into a desired shape by being bent to be fitted into the groove of the bending die 490 under the tension. To bend the work piece 480 to be fitted into the groove of the bending die 490, swinging movement (arrow A) of the arms 440, horizontal movement (arrow B) of the pillars to and from the support shafts 430, and vertical movement (arrow C) of the lifts 460 are utilized.

However, such stretch benders must be built of heavy material in order to ensure rigidity of the device. Especially, since each pillar 450 is supported by a single arm 440 in a slidable manner, it is necessary to adopt material having a large cross section. Furthermore, in order to drive the pillars 450 and the lifts 460, high-powered motors are required.

SUMMARY OF THE INVENTION

An object of the present invention is to provide a stretch bender which can maintain desired rigidity without using heavy material.

Another object of the present invention is to provide a stretch bender which can perform accurate bending using low-powered drive sources.

Further object of the present invention is to provide a stretch bender which is easy to operate.

To attain these and other objects, the present invention provides a stretch bender for bending a strip work piece by thrusting it against a bending die while applying axial tension to the work piece, comprising a pair of support shafts, and a pair of rotating members rotatably supported by the support shafts and provided with two arm members and a coupling member for connecting the arm members, each of the arm members extending outward from the support shafts.

Each of the rotating members comprises a guide member extending between the two arm members which can move to a direction parallel to the longitudinal direction of the arm members, a chuck mechanism, for gripping the strip work piece, arranged movable to a direction orthogonal to the longitudinal direction of the arm members, and a tension application mechanism for moving the guide member with respect to the arm members and applying tension to the work piece gripped by the chuck mechanism.

The stretch bender of the present invention further comprises rotation control means for controlling rotation of the rotating members in order to thrust the work piece gripped by the chuck mechanisms against the bending die.

High rigidity of the device is realized by the U-shaped rotating members which are constituted of the arm members, parallel to each other and supporting the guide member which holds the chuck mechanism gripping the work piece, and the coupling member by means of which the arm members are connected.

Accordingly, the stretch bender of the present invention can be built without using heavy material and also without deteriorating bending accuracy.

The tension application mechanism may comprise a first drive source for moving one end of the guide member along one of the arm members, a second drive source for moving the other end of the guide member along the other arm member, a tension sensor for detecting tension applied to the work piece, a position sensor for detecting a position of the guide member, and control means for controlling torque of the first drive source based on the tension detected by the tension sensor and also controlling the second drive source based on the position detected by the position sensor.

If the tension application mechanism is constituted as such, drive force for moving the guide member can be shared between the two drive sources having low power. In addition, since the first drive source of the tension application mechanism is controlled based on the tension and the second drive source is controlled based on the position of the guide member, the guide member can be moved with high accuracy by a pair of drive sources while desired tension is applied to the work piece.

The control means may adjust the torque of the first drive source to predetermined target torque based on the tension detected by the tension sensor. Additionally, the control means may comprise storage means for storing the position of the guide member detected by the position sensor and a control value for adjusting the torque of the first drive source to the target torque. It is also possible to provide position control means which, after stretch bending of one work piece, controls the first drive source according to the control value stored in the storage means instead of the control means.

It is preferable that a table on which the bending die is mounted is provided in a tiltable manner. As such, even if the position of the chuck mechanism on the guiding member is reached to its upper or lower limit and further move is restrained, it is possible to place the chuck mechanism at a desired position with respect to the bending die by tilting the table. Thus, it is possible to expand the range of position within which the chuck mechanism can be placed with respect to the bending die and continue bending without interruption. In other words, unless the table is tiltable, the work piece has to be taken off from the chuck mechanism when the position of the chuck mechanism is reached to its upper or lower limit, and the work piece is again attached to the chuck mechanism with its chuck position modified. The above constitution can save such time and labor.

It is preferable that when an operator performs teaching, bending is performed as taught. In this way, bending becomes easy to perform.

The drive sources for driving the guide member may be selectively operated either in a torque control mode or in a position control mode. In this case, the drive sources are driven in the torque control mode to generate predetermined tension, and the positions that the guide member takes at that time are stored in the storage means. In the position control mode, the drive sources are controlled based on the position data stored in the storage means. In initial stretch bending, the guide member is moved in the torque control mode to obtain desired tension. However, once the position of the guide member is fixed, it is possible to perform bending with application of the desired tension only by moving the guide member to the fixed position in the position control mode.

BRIEF DESCRIPTION OF THE DRAWING FIGURES

The invention will now be described, by way of examples, with reference to the accompanying drawings, in which.

DETAILED DESCRIPTION OF THE INVENTION

[First Embodiment]

Figure 1:
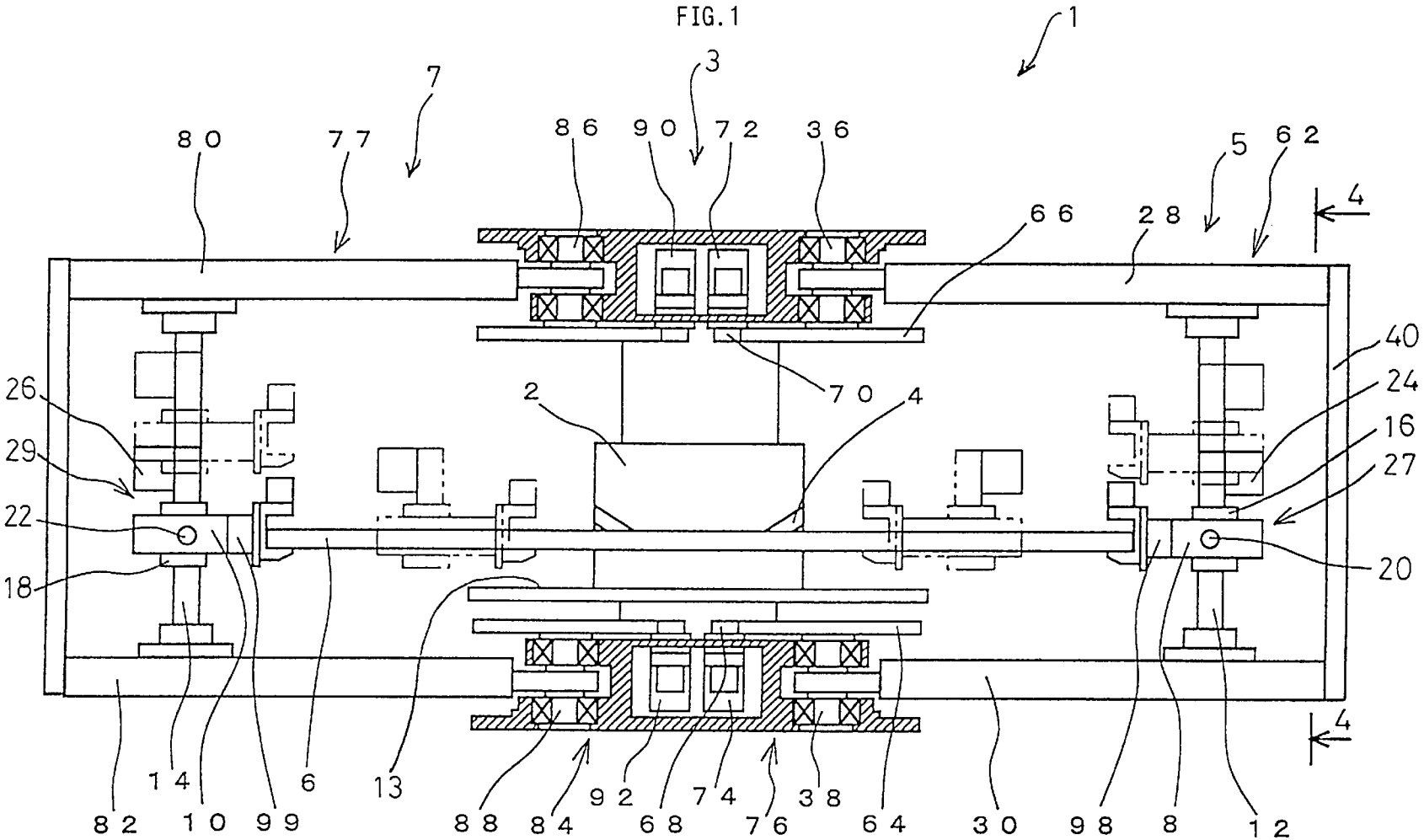
FIG. 1 is a schematic elevation view of a stretch bender according to a first embodiment of the present invention, partly showing cross sections thereof.
Figure 2:
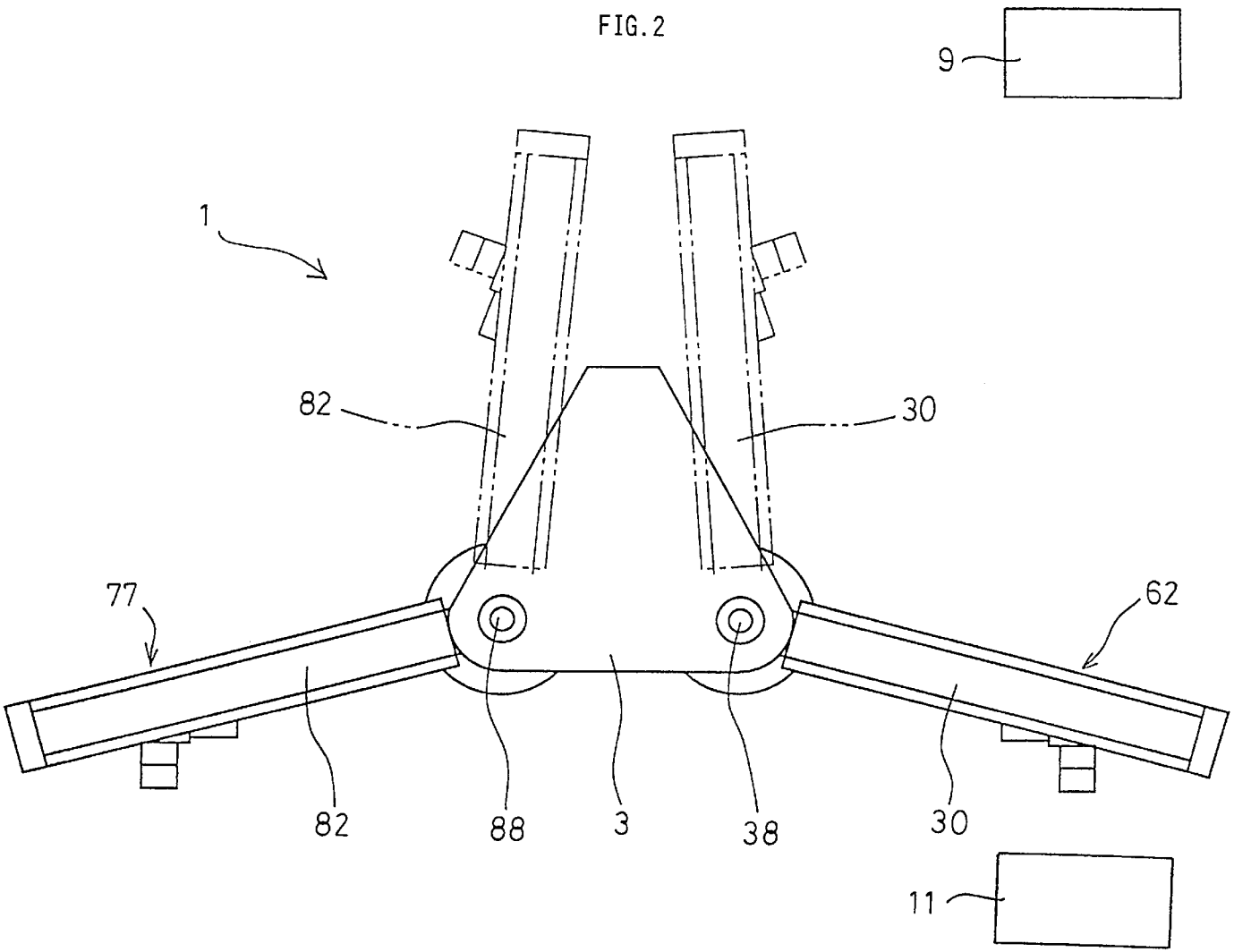
FIG. 2 is a schematic plane view of the stretch bender of the first embodiment.

As shown in FIGS. 1 and 2, a stretch bender 1 of this embodiment mainly comprises a base 3 having a table 13 on which a bending die 2 is mounted, and U-shaped arms 5, 7 attached to the base 3 in a swingable manner and provided with chuck mechanisms 8, 10 for gripping both ends of a strip work piece 6. In the neighborhood of the stretch bender 1, a control device 9 and an operation console 11 are arranged for controlling the stretch bender 1.

Figure 3A:
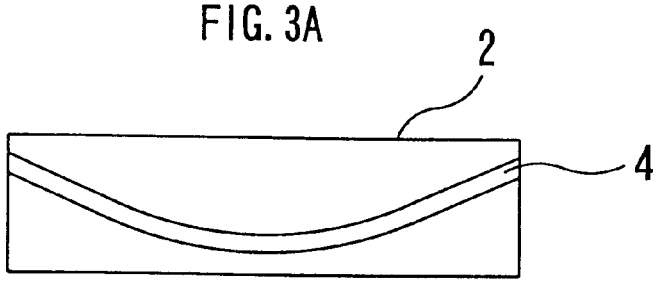
FIGS. 3A, 3B and 3C are a plane view, an elevation view and a right side view, respectively, of an example of a bending die used in the stretch bender.
Figure 3B:
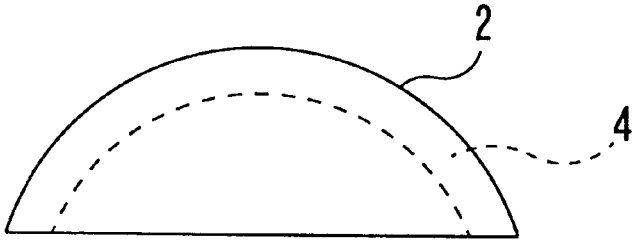
Figure 3C:
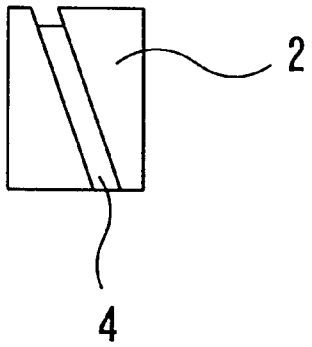

A groove 4, illustrated in FIGS. 3A, 3B and 3C as an example, suitable for bending to be performed is formed on the bending die 2. The work piece 6 is inserted into this groove 4 and bent along the same under tension to be formed into a desired shape. For this purposes the chuck mechanisms 8, 10 for gripping both ends of the work piece 6 are arranged on both sides of the bending die 2.

The chuck mechanisms 8, 10 are arranged on lifts 16, 18 supported in a slidable manner along a pair of pillar guide members 12, 14 which extend orthogonal to the work piece 6. The chuck mechanisms 8, 10 are supported in a swingable manner around swinging shafts 20, 22 attached to the lifts 16, 18, and they can swing up and down freely within an angle of 30 degrees to both sides of a horizontal plane, for example The lifts 16, 18 are supported in a swingable manner around the guide members 12, 14. They can swing right and left freely within an angle of 45 degrees to both sides of a vertical plane in which both of the lifts 16, 18 face to each other, for example. Accordingly, the chuck mechanisms 8, 10 can swing to both vertical and horizontal directions freely within the aforementioned angles, so that they can take appropriate positions according to a direction of the applied tension.

Motors 24, 26 are mounted respectively on the lifts 16, 18, and by driving the motors 24, 26, the lifts 16, 18 can move up and down along the guide members 12, 14.

In the present embodiment, the lift 16, swinging shaft 20 and motor 24 constitute a right vertical move mechanism 27, and the lift 18, swinging shaft 22 and motor 26 constitute a left vertical move mechanism 29.

Figure 4:
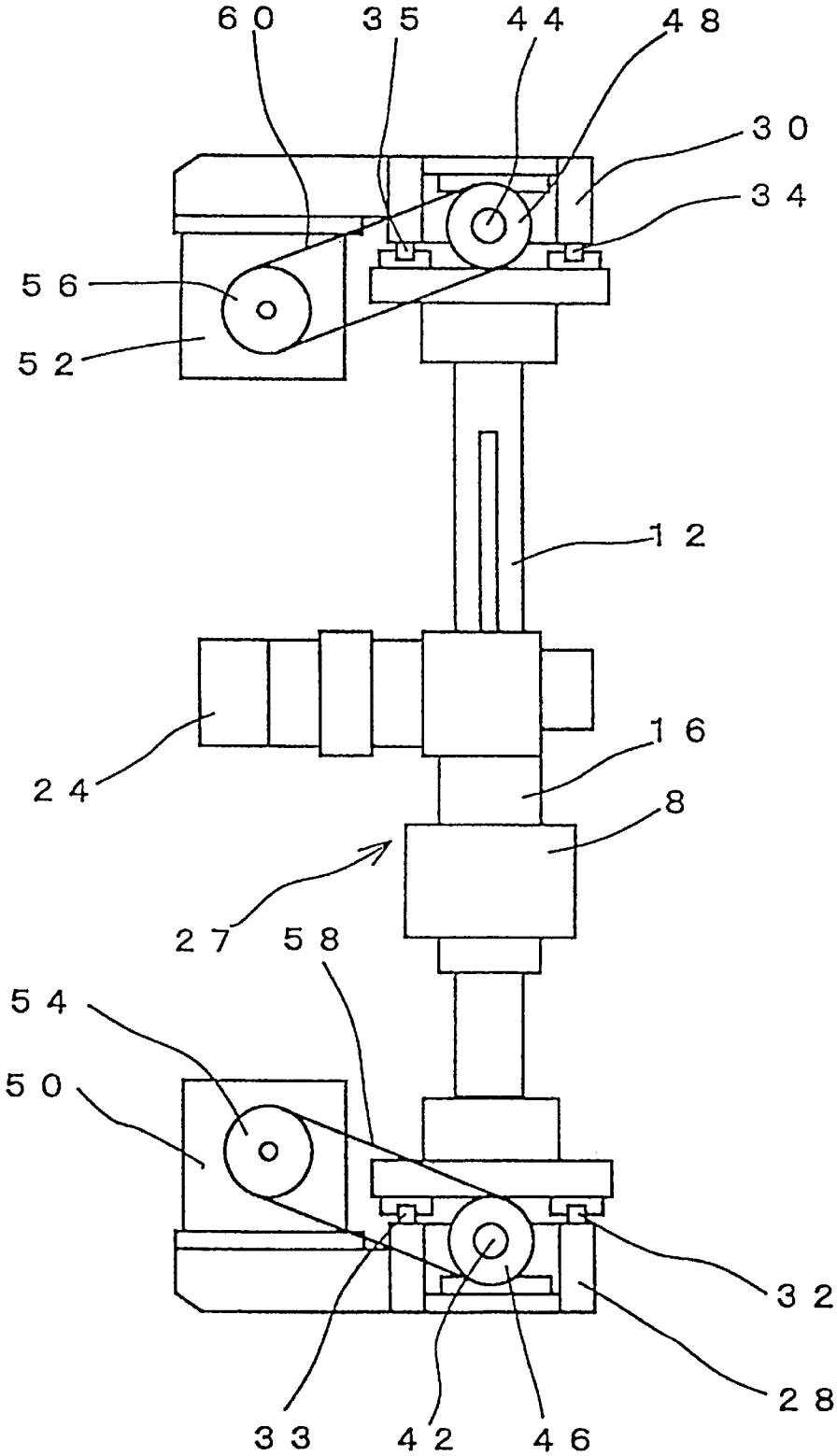
FIG. 4 is an enlarged view of the stretch bender taken along the line 4—4 in FIG. 1.

As shown in FIG. 4, linear rails 32 and 33 and linear rails 34 and 35 are laid on a pair of arm members 28, 30, respectively. Both ends of the guide member 12 of the right vertical move mechanism 27 abut on the rails 32 and 33 and the rails 34 and 35, and are supported by the same in a slidable manner. As can be seen in FIG. 1, the arm members 28, 30 are, on one end, attached to a pair of rotation shafts 36, 38, respectively, which are supported rotatably by the base 3, and, on the other end, attached to a coupling member 40. The arm members 28, 30 and coupling member 40 form a U-shaped arm 5 and accordingly, rigidity of the device is improved.

Referring to FIG. 4, ball screws 42, 44 (the left vertical move mechanism 29 is not shown) are arranged parallel to the rails 32–35 on the arm members 28, 30. The guide member 12 is adapted to move forward and backward along with rotation of the ball screws 42, 44. The ball screws 42, 44 comprise pulleys 46, 48, respectively. First and second drive sources 50, 52 having motors are respectively attached adjacent to the respective arm members 28, 30, and belts 58, 60 are attached between the pulleys 46, 48 and pulleys 54, 56, respectively. The pulleys 54, 56 are respectively attached to rotation shafts of the first and second drive sources 50, 52.

In the present embodiment, the arm members 28, 30, rails 32–35, rotation shafts 36, 38, coupling member 40, ball screws 42, 44, pulleys 46, 48, 54, 56, first and second drive sources 50, 52 and belts 58, 60 constitute a right tension application mechanism 62.

In FIG. 1, gear wheels 64, 66 are attached to the rotation shafts 36, 38, respectively, and pinions 68, 70 mesh the gear wheels 64, 66, respectively. The pinions 68, 70 are respectively attached to rotation shafts of upper and lower drive sources 72, 74 having motors. In the present embodiment, the gear wheels 64, 66, pinions 68, 70 and drive sources 72, 74 constitute a right lap mechanism 76. The lap mechanism is a mechanism for swinging, that is, rotating the aforementioned U-shaped arms. Also, an axis for the rotation is called a lap axis.

Similarly, the guide member 14 of the left vertical move mechanism 29 is adapted to move the left chuck mechanism 10 along a pair of arm members 80, 82 by driving first and second drive sources 78, 79 of a left tension application mechanism 77. In addition, a left lap mechanism 84 enables the arm members 80, 82 to be rotated around rotation shafts 86, 88 by upper and lower drive sources 90, 92.

Figure 5:
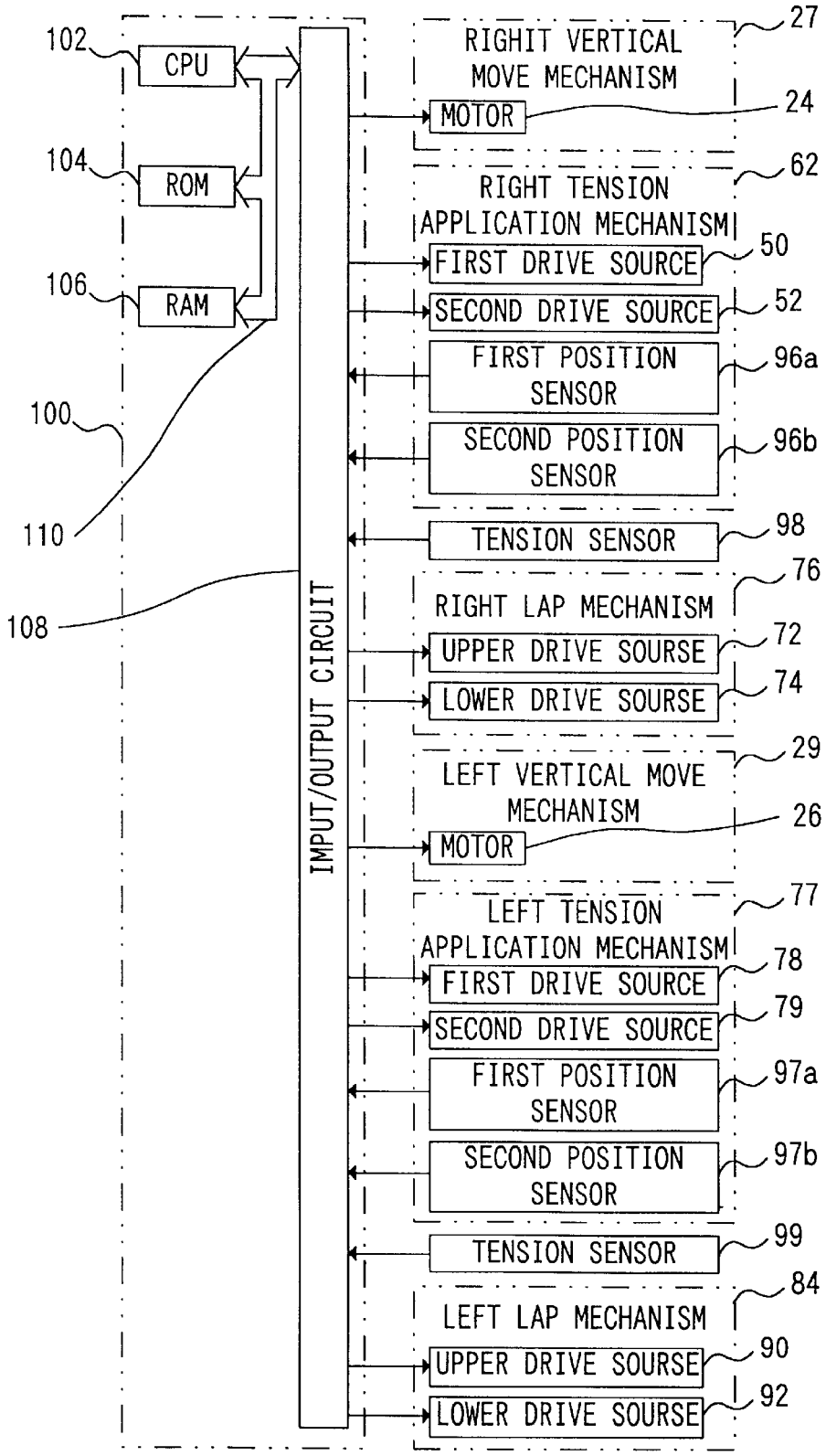
FIG. 5 is a block diagram of an electric system in the first embodiment.

As illustrated in FIG. 5, first and second position sensors 96*a*, 96*b* for detecting positions of the guide member 12 with respect to the arm members 28, 30 are provided in the right tension application mechanism 62. First and second position sensors 97*a*, 97*b* for detecting positions of the guide member 14 with respect to the arm members 80, 82 are provided in the left tension application mechanism 77. In addition, in order to detect tension applied to the work piece 6, a tension sensor 98 having a load cell is provided for the right tension application mechanism 62, and a tension sensor 99 is provided for the left tension application mechanism 77.

The motors 24, 26, first and second drive sources 50, 52, 78, 79 of the right and left tension application mechanisms 62, 77, upper and lower drive sources 72, 74, 90, 92 of the right and left lap mechanisms 76, 86, first and second position sensors 96*a*, 96*b*, 97*a*, 97*b* and tension sensors 98, 99 are all connected to an electronic control circuit 100.

The electronic control circuit 100 is a logic circuit mainly comprising CPU 102, ROM 104 and RAM 106, and is interconnected to an input/output circuit 108 via a common bus 110. The input/output circuit 108 controls input and output of the motors 24, 26, first and second drive sources 50, 52, 78, 79 and upper and lower drive sources 72, 74, 90, 92.

The CPU 102 takes in data from the first and second position sensors 96*a*, 96*b*, 97*a*, 97*b* and tension sensors 98, 99 via the input/output circuit 108, and executes calculation using data stored in the ROM 104 and RAM 106 and a built-in control program. The CPU 102 outputs drive signals to the motors 24, 26, first and second drive sources 50, 52, 78, 79 and upper and lower drive sources 72, 74, 90, 92 via the input/output circuit 108.

Upon tension stretching, the first and second drive sources 50, 52, 78, 79 of the right and left tension application mechanisms 62, 77 are driven to apply tension to the work piece 6 gripped by the chuck mechanisms 8, 10. While the motors 24, 26 are driven to move up and down the chuck mechanisms 8, 10 according to a form of the groove 4, the upper and lower drive sources 72, 74, 90, 92 of the right and left lap mechanisms 76, 84 are driven to swing the arm members 28, 30, 80, 82 around the rotation shafts 36, 38, 86, 88. As a result, the work piece 6 is inserted into the groove 4 and thrust against the bending die 2 under the tension, to be stretched and bent.

From now on, operation for applying desired tension to the work piece 6 is explained.

Figure 6:
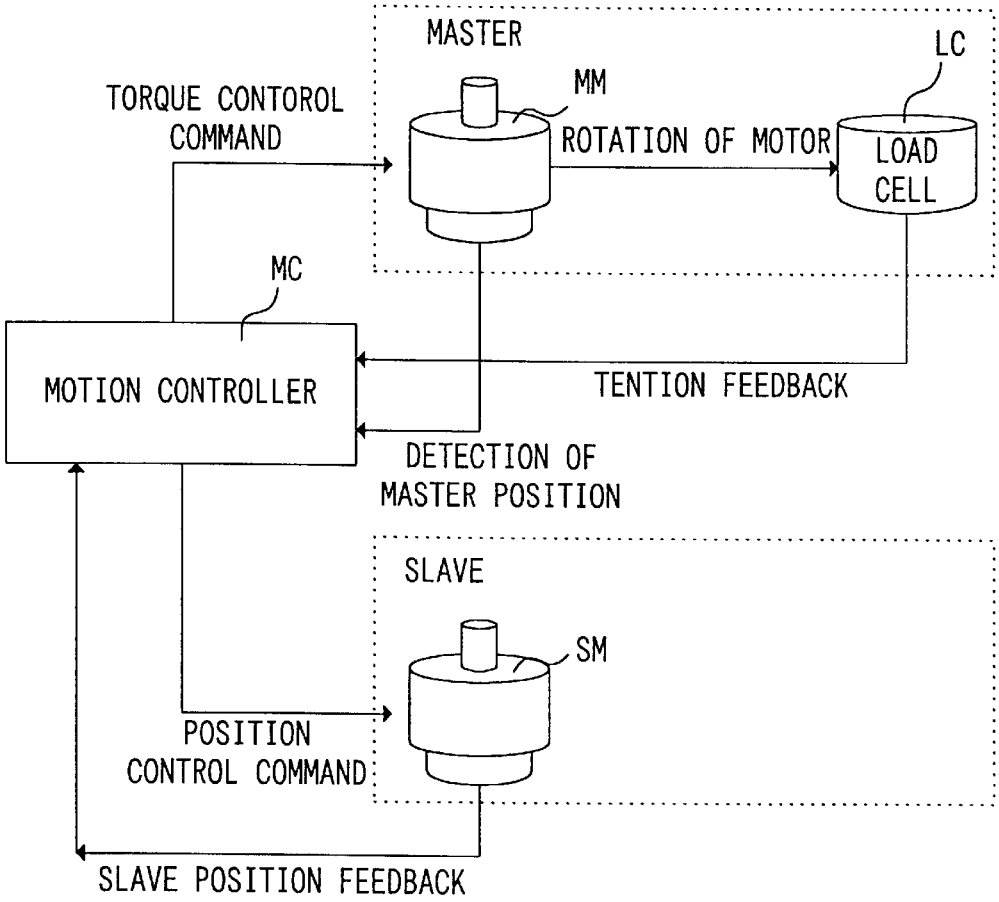
FIG. 6 is an explanatory view illustrating master-slave control in a tension application mechanism of the first embodiment.

As shown in FIG. 6, master-slave control is adopted in the right and left tension application mechanisms 62, 77 of the present embodiment. As shown in FIGS. 4 and 5, the first drive sources 50, 78 on the lower side are controlled as master devices, and the second drive sources 52, 79 on the upper side are controlled as slave devices. Only the operation of the right tension application mechanism 62 is described below, but it is understood that the left side tension application mechanism 77 operates in the same way.

In FIG. 6, a motion controller MC which constitutes a part of the electronic control circuit 100 transmits a torque control command to a motor MM. The motor MM is the first drive source 50 on the master side. The motor MM operates according to the torque control command. Tension is generated in the work piece 6 according to rotation of the motor MM, and the generated tension is detected by a load cell LC. The load cell LC constitutes the first position sensor 96*a*.

The detected tension is fed back to the motion controller MC for control of the motor MM so that the desired tension is always applied to the work piece 6. In the meantime, the rotational position (rotation angle) of the motor MM is detected at all times, and the detected rotational position is transmitted to the motion controller MC.

The motion controller MC transmits a position control command to a motor SM on the slave side. The motor SM rotates according to the position control command, and the rotational position of the motor SM is fed back to the motion controller MC.

Figure 7:
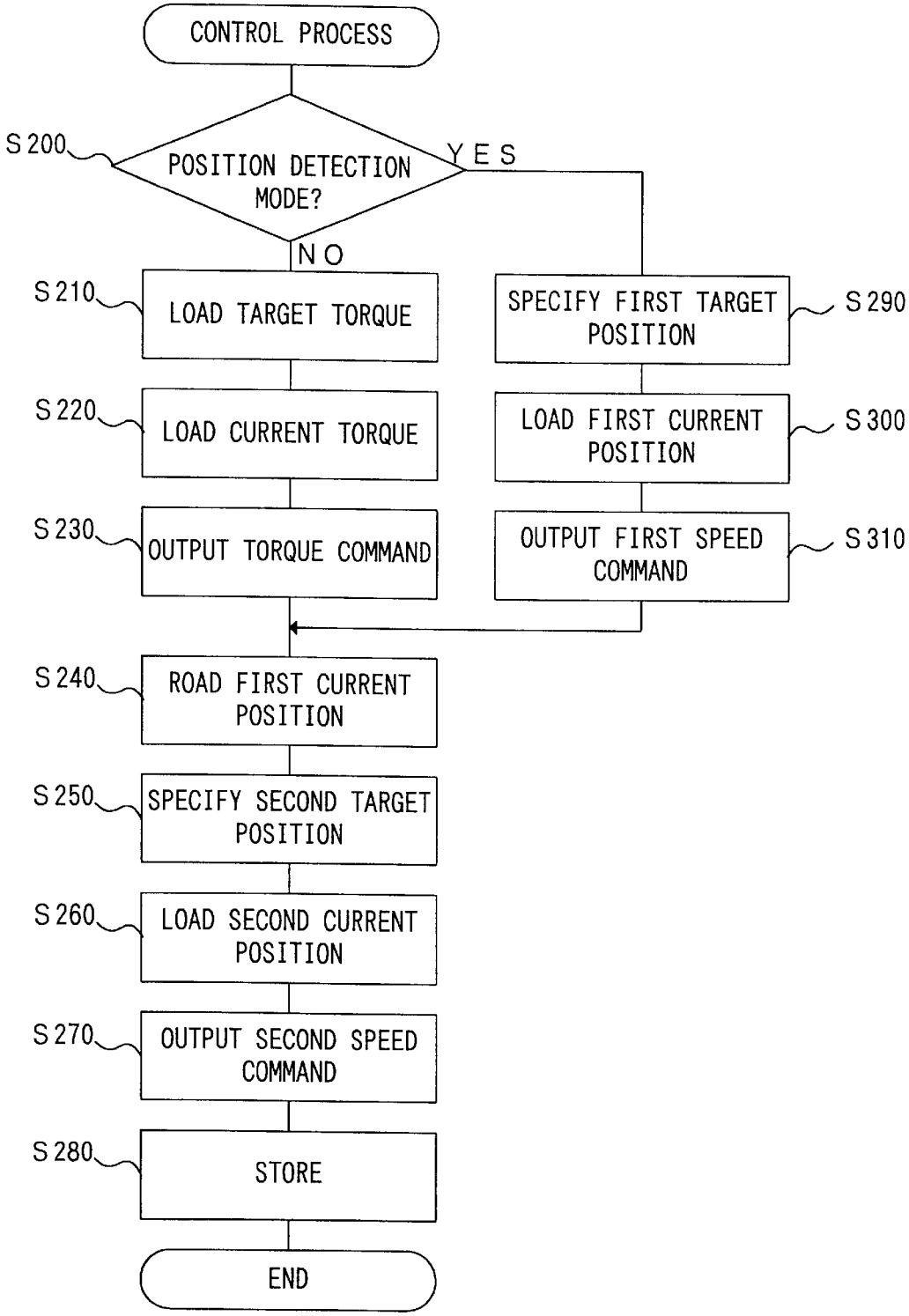
FIG. 7 is a flowchart illustrating a control process performed in an electronic control circuit of the first embodiment.

Now, a control process for applying tension to the work piece 6 executed in the aforementioned electronic control circuit 100 is described by way of a flowchart in FIG. 7. Only the operation in the right tension application mechanism 62 is explained below, since the left tension application mechanism 77 operates in the same way as the right tension application mechanism 62.

Firstly, it is determined whether a position detection mode is selected (Step 200). In the present embodiment, the tension application mechanism is provided with two modes, namely, a tension detection mode and a position detection mode. Operation in the tension detection mode is followed by that in the position detection mode. Accordingly, if the operation in the tension detection mode is not yet executed, it is determined that the position detection mode is not selected, and target torque of the first drive source 50 is loaded (Step 210).

The target torque of the first drive source 50 is predetermined and being stored beforehand. It is the torque for generating tension required for stretching of the work piece 6. The target torque is set differently for respective stages of the stretch bending.

Current torque of the first drive source 50 based on the tension detected by the tension sensor 98 is loaded (Step 220). A control value is calculated based on this current torque and the target torque and is outputted to the first drive source 50 (Step 230). Subsequently, a position of the guide member 12 detected by the first position sensor 96*a* is loaded (Step 240). In the present embodiment, the first position sensor 96*a* detects the position of the guide member 12 based on rotation of the ball screw 42 or that of the first drive source 50.

According to the detected position of the guide member 12, the second drive source 52 is informed of a target position (Step 250). Then, a current position of the guide member 12 on the side where the second drive source 52 is provided is detected by the second position sensor 96*b* (Step 260). A control value is calculated based on the current position and the target position and is outputted to the second drive source 52 (Step 270). In the present embodiment, the position of the guide member 12 on the side where the second drive source 52 is provided is detected by rotation of the ball screw 44 or that of the second drive source 52.

As such, the work piece 6 is stretched and bent, and the control value for the first drive source 50 and the positions of the guide member 12 during the bending are associated to each other and stored (Step 280). After the stretch bending of one work piece 6, a new work piece 6 is attached and bent to be stretched again. After execution of Step 200, if it is determined that the position detection mode is selected, the target position stored in Step 280 is then outputted to the first drive source 50 (Step 290).

In the next step, the current position of the guide member 12 detected by the first position sensor 96*a* is loaded (Step 300). On the basis of the current position and the target position, a speed command value is outputted to the first drive source 50 (Step 310). Thereafter, the aforementioned Step 240 and onwards are executed.

A position of the chuck mechanism 8 gripping the work piece 6 is defined by an angle of the lap axis of the right lap mechanism 76, a distance from the original position of the chuck mechanism 8 in the right tension mechanism 62, and a vertical position of the chuck mechanism 8 in the right vertical move mechanism 27. Here, the angle of the lap axis is determined by rotational positions of the upper drive source 72 and the lower drive source 74. The distance from the original position of the chuck mechanism 8 in the right tension mechanism 62 is determined by rotational positions of the first and second drive sources 50, 52. The vertical position in the right vertical move mechanism 27 is determined by a rotational position of the motor 24.

[Second Embodiment]

Figure 8:
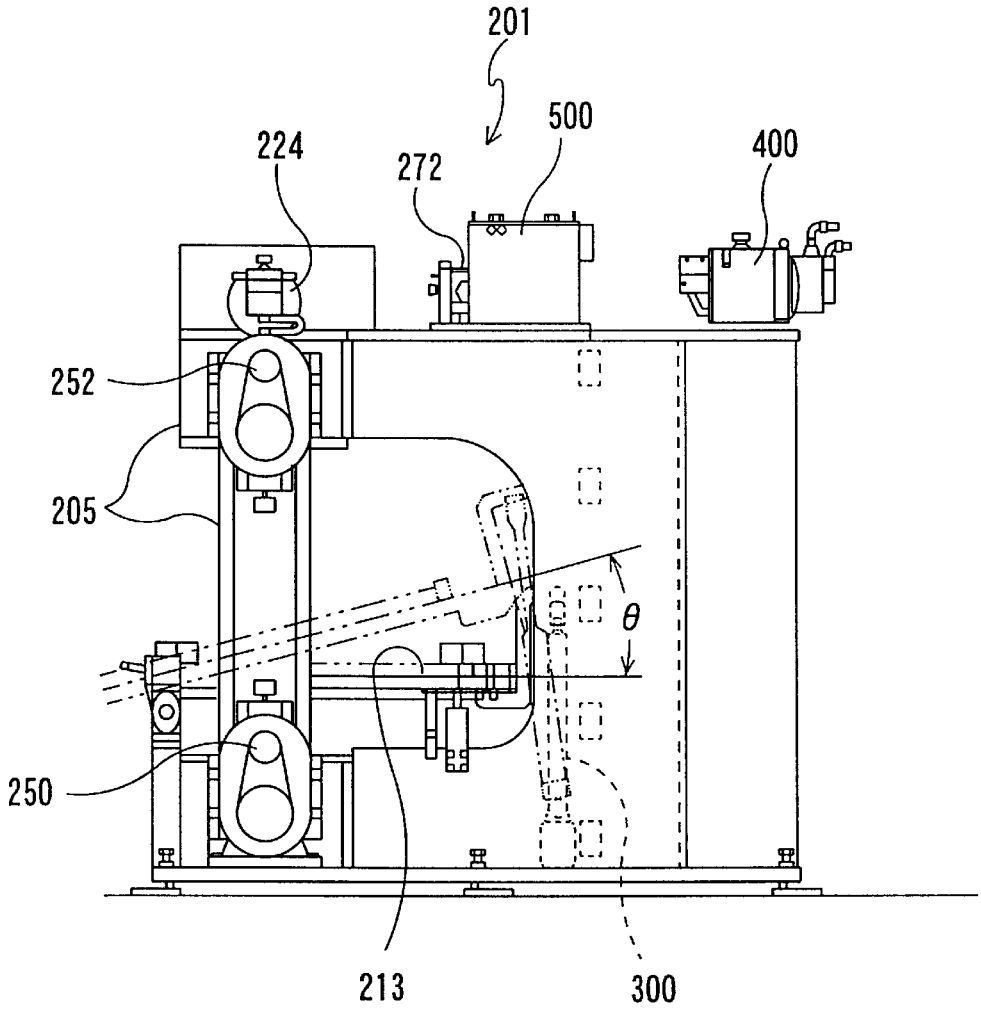
FIG. 8 is a schematic side view of a stretch bender according to a second embodiment of the present invention.

As shown in FIG. 8, a stretch bender 201 in this embodiment comprises a table 213 supporting a bending die and arranged in a tiltable manner. The table 213 can be tilted up to a position having an angle of θ indicated by a chained line, from a horizontal plane indicated by a full line. The angle θ is 15 degree, for example. The table 213 is made tiltable so as not to limit vertical move of the chuck mechanisms 8, 10 when the work piece 6 is bent along the groove 4 provided on the bending die 2. In the present embodiment, the table 213 is tilted when the chuck mechanisms 8, 10 have to be moved to a position beyond its predetermined range in relation to the groove 4. In this case, the left and right lap and tension mechanisms are also operated, if required.

In FIG. 8, first and second drive motors 250, 252 are motors for respectively applying tension to the work piece 6. A drive motor 224 is for moving up and down a chuck mechanism not shown in FIG. 8, a piston 300 is for tilting the table 213, a hydraulic pomp 400 is for supplying hydraulic thrusture to the piston 300, and a hydraulic pomp 500 is for swinging the arm 205. Descriptions for other compositions are omitted since they are the same as in the first embodiment.

Figure 9:
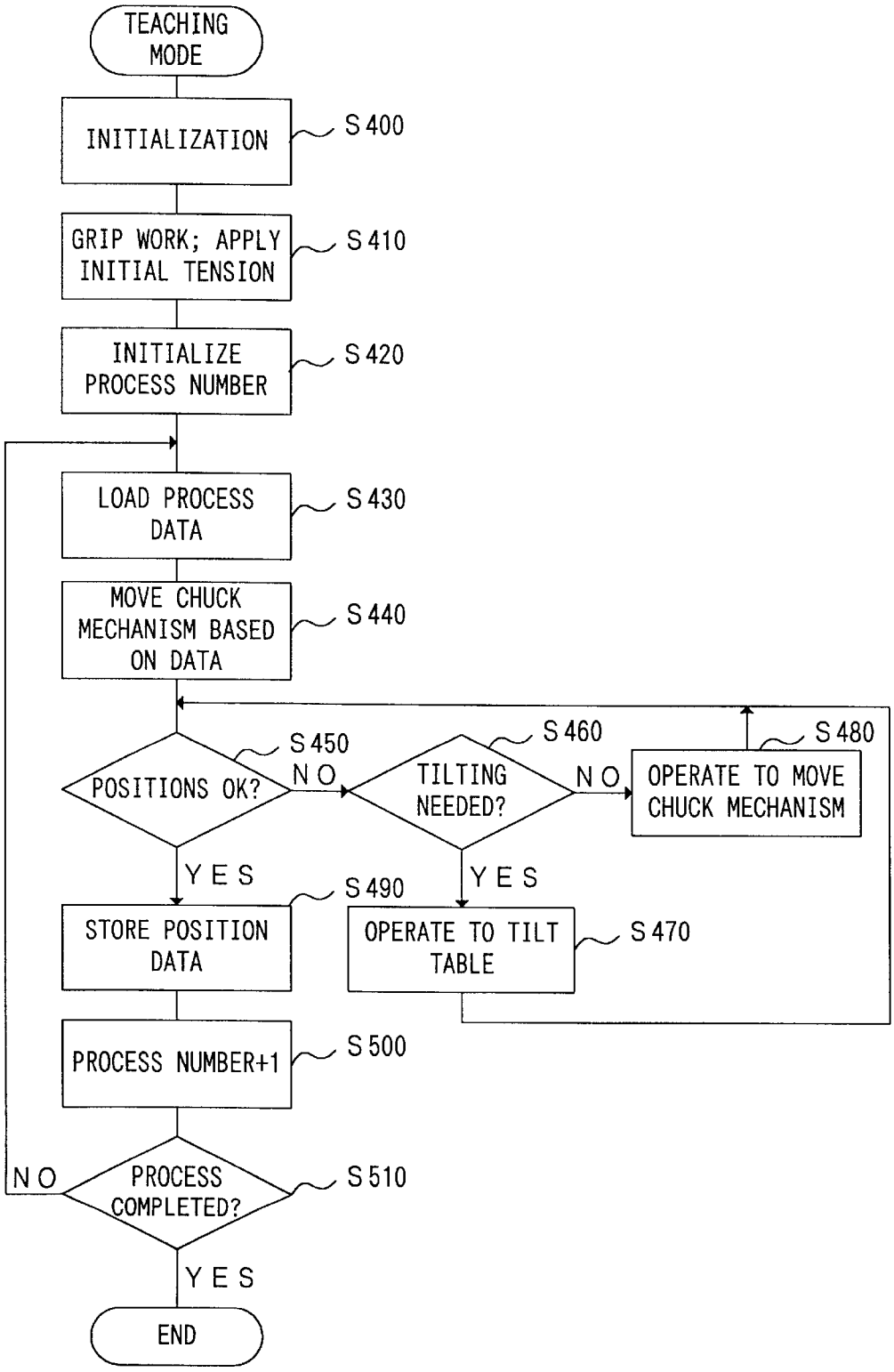
FIG. 9 is a flowchart illustrating operation in the stretch bender of the second embodiment in a teaching mode.
Figure 10A:
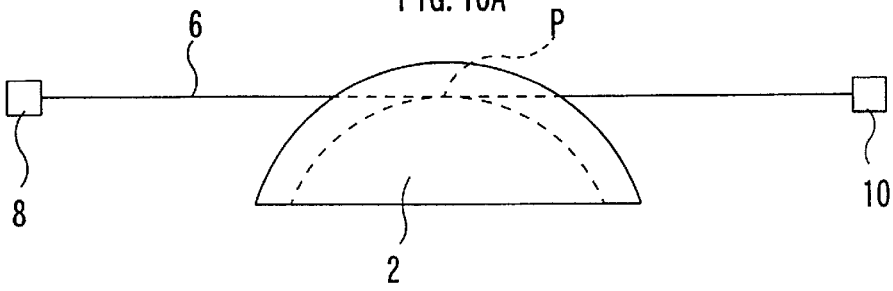
FIGS. 10A–10D are diagrams illustrating the operations in the teaching mode.
Figure 10B:
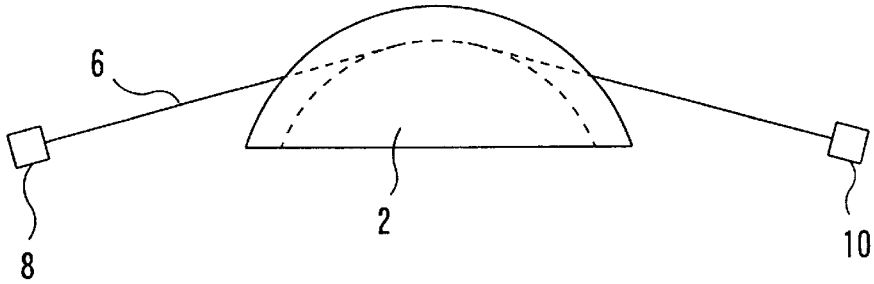
Figure 10C:
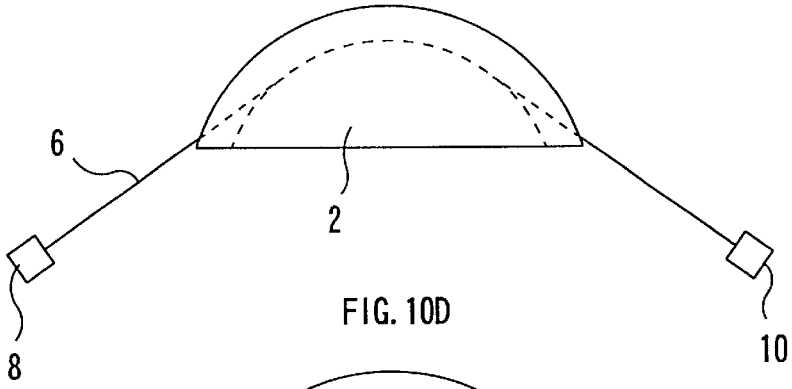
Figure 10D:
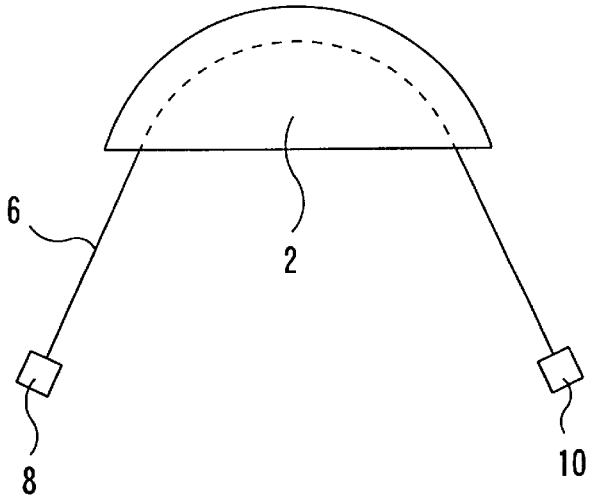
Figure 11A:
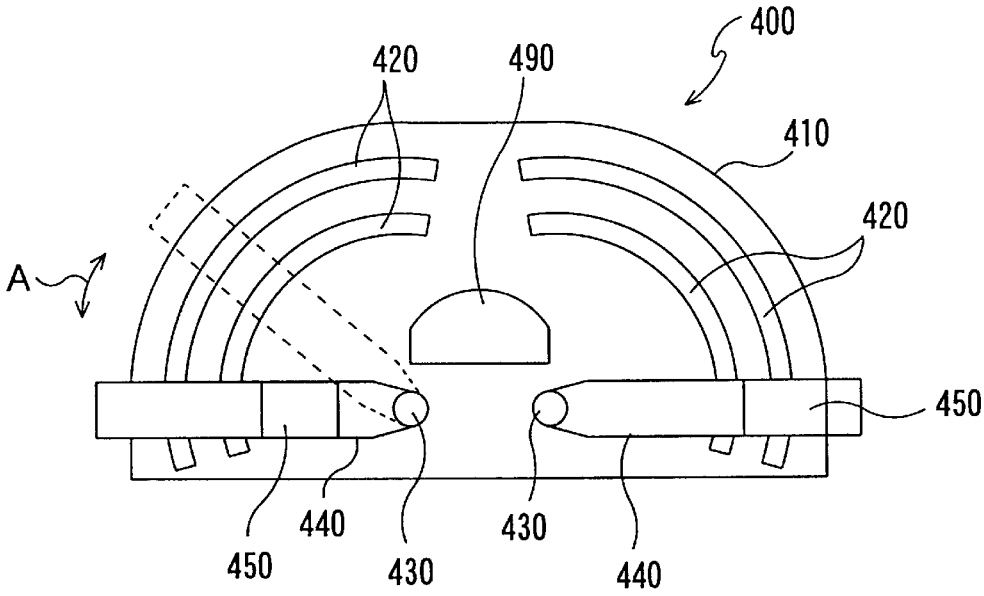
FIGS. 11A and 11B are diagrams illustrating background technique of the present invention.
Figure 11B:
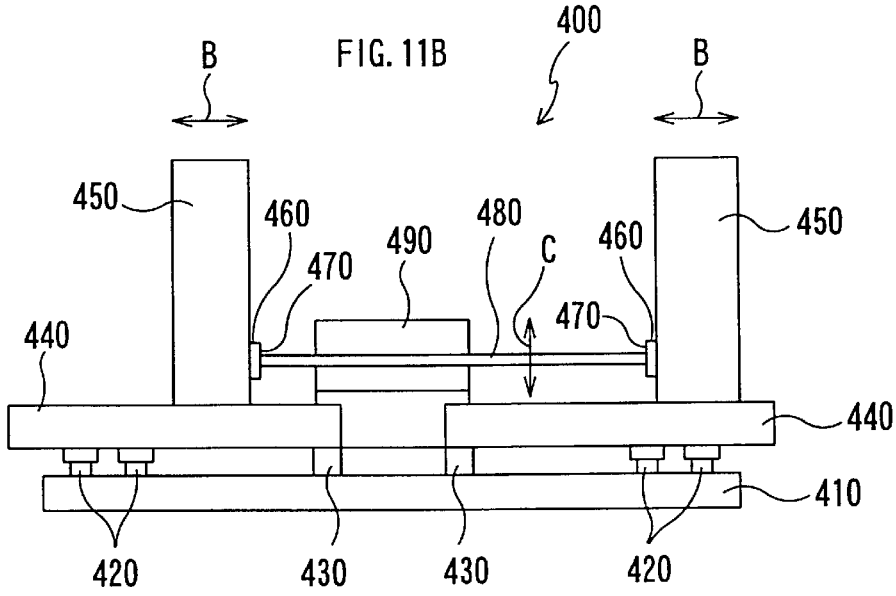

The stretch bender in the present invention is operated not only according to a preset program, but also as taught. FIG. 9 is a flowchart explaining operation in a teaching mode, and FIGS. 10A–10D are diagrams for illustrating the bending operation. FIG. 10A shows a state that the work piece 6 gripped by the chuck mechanisms 8, 10 is in contact with the bending die 2 at the point P. FIGS. 10B–10D show states of gradual increase in bending angle.

Now, an operation of the stretch bender 201 in the teaching mode is explained by way of FIGS. 9 and 10A–10D.

The following conditions are assumed in the teaching mode explained herein.

A plurality of stages, for example, 4 stages, are provided in bending of the work piece 6 as shown in FIGS. 10A–10D.

Scheduled positions in which the chuck mechanisms 8, 10 should take in respective stages are stored as process data beforehand, and the chuck mechanisms 8, 10 are moved to the scheduled positions automatically.

An operator moves the chuck mechanisms 8, 10 in each stage by using the operation console 11, and determines the positions of the chuck mechanisms 8, 10 in each stage.

The determined positions are stored and the next bending will be performed according to the data stored.

In Step 400, initialization such as moving the chuck mechanisms 8, 10 to their home positions is executed. In Step 410, both ends of the work piece 6 are gripped by the chuck mechanisms 8, 10, and by moving the chuck mechanisms 8, 10, predetermined initial tension is generated in the work piece 6. In Step 420, a process number stored in the RAM 106 is initialized.

In Step 430, among the process data stored beforehand in the RAM 106, the data corresponding to a current process number is loaded. In Step 440, the chuck mechanisms 8, 10 are moved based on the process data loaded.

In Step 450, the operator determines whether the positions of the chuck mechanisms 8, 10 are appropriate, and in Step 460, determines whether tilting of the table 213 is necessary. If the positions of the chuck mechanisms 8, 10 are appropriate, the operator transmits a determination command from the operation console 11. In this case, the process proceeds to Step 490, and the data for defining the positions of the chuck mechanisms 8, 10 are stored in a predetermined area of the RAM 106.

If the tilting of the table 213 is not necessary, the process proceeds to Step 480, and the operator operates the operation console 11 to move the chuck mechanisms 8, 10 to the appropriate positions.

On the other hand, if the tilting of the table 213 is necessary, the process proceeds to Step 470, and the operator operates the operation console 11 to tilt the table 213 to the appropriate angle. Accordingly, bending of the work piece which cannot be achieved by the vertical move of the chuck mechanisms 8, 10 is realized.

When the position data are stored in Step 490, the process proceeds to Step 500 where the process number is incremented by one and then proceeds to Step 510.

In Step 510, it is determined whether the process is completed at all. If not, the process returns to Step 430 to repeat the aforementioned operation. If it is determined that the process is completed in Step 510, the operation in the teaching mode is ended.

The present invention is not limited to the above embodiment, and other modifications and variations are possible within the scope of the present invention. For example, in case of bending a work piece using a bending die which is symmetrical, teaching may be conducted for only one of the sides, and by copying data obtained by the teaching, teaching to be done on the other side may be omitted.

Moreover, in the aforementioned embodiment, the scheduled positions in which the chuck mechanisms 8, 10 should take are preset in the teaching mode. However, the positions may be determined only by the operation of the operator, without the presetting.

Furthermore, the tension to be applied to the work piece may be monitored, and when there is an abnormal change in the tension, it is determined that the work piece is broken and the operation of the tension and lap mechanisms may be stopped automatically.

As above explained, mechanical rigidity is improved by the stretch bender of the present invention, since both ends of the guide member which guides the chuck mechanisms gripping the work piece are supported by the pair of arm members and the arm members are connected by the coupling member. Moreover, accurate movement is achieved by the pair of drive sources, since the first drive source of the tension application mechanism is controlled by the tension and the second drive source is controlled based on the position. Accordingly, the stretch bender of the present invention can perform accurate stretch bending even of large-sized parts.

What is claimed is:

1. A stretch bender for bending a strip work piece by thrusting it against a bending die while applying tension to the work piece, comprising:

a pair of support shafts, a pair of rotating members rotatably supported by the support shafts, each of the rotating members having two arm members and a coupling member for connecting the arm members, the arm members being parallel to each other and extending outward from the respective support shafts, and rotation control means for controlling rotation of the rotating members to thrust the work piece gripped by the chuck mechanisms against the bending die, wherein each of the rotating members further comprises a guide member extending between the two parallel arm members and arranged movable to a direction parallel to the arm members, a chuck mechanism which is guided by the guide member and arranged movable to a direction orthogonal to the arm members, for gripping the strip work piece, and a tension application mechanism for moving the guide member in relation to the arm members to apply tension to the work piece gripped by the chuck mechanism.

2. The stretch bender set forth in claim 1, wherein said tension application mechanism comprises:

a first drive source for moving one end of said guide member along one of said arm members, a second drive source for moving the other end of the guide member along the other of the arm members, a tension sensor for detecting tension applied to said work piece, a position sensor for detecting a position of the guide member, and control means for adjusting torque of the first drive source based on the tension detected by the tension sensor as well as controlling the second drive source based on the position detected by the position sensor.

3. The stretch bender set forth in claim 2, wherein said control means adjust the torque of said first drive source to predetermined target torque, based on the tension detected by said tension sensor.

4. The stretch bender set forth in claim 3, wherein said control means further comprises storage means for storing the position of said guide member detected by said position sensor and a control value for adjusting the torque of said first drive source to the target torque.

5. The stretch bender set forth in claim 4, wherein said control means further comprises position control means for, when stretching and beading of one work piece is completed, controlling said first drive source according to said control value stored in said storage means instead of said control means.

6. The stretch bender set forth in claim 1, further comprising a table on which a bending die is mounted and tilting means for tilting the table.

7. A stretch bender for bending a strip work piece by thrusting it against a bending die while applying tension to the work piece, comprising:

chuck mechanisms for gripping the strip work piece, guide members for guiding the chuck mechanisms and which permit the chuck mechanisms to move orthogonal to an axial direction of the work piece gripped by the chuck mechanisms, rotating members attached rotatably to support shafts, for supporting the guide members movably, tension application mechanisms for applying tension to the work piece gripped by the chuck mechanisms, rotation control means for controlling rotation of the rotating members to thrust the work piece gripped by the chuck mechanisms against the bending die, teaching means for teaching desired operation procedures to the tension application mechanisms and rotation control means, and control means for controlling operation of the tension application means and rotation control means according to the procedures taught by the teaching means.

8. A stretch bender for bending a strip work piece by thrusting it against a bending die while applying tension to the work piece, comprising:

chuck mechanisms for gripping the strip work piece, guide members for guiding the chuck mechanisms which permit the chuck mechanisms to move orthogonal to an axial direction of the work piece gripped by the chuck mechanisms, rotating members attached rotatably to support shafts, for supporting the guide members movably, tension application mechanisms having drive sources for applying tension to the work piece gripped by the chuck mechanisms, rotation control means for controlling rotation of the rotating members to thrust the work piece gripped by the chuck mechanisms against the bending die, position sensors for detecting positions of the guide members, storage means for storing the positions detected by the position sensors, selection means for selecting one of a torque control mode and a position control mode, torque command means for providing torque to the drive sources, and position command means for providing the positions to the drive sources, wherein the tension application mechanisms further comprise control means for driving the drive sources based on the torque provided from the torque command means and for storing the positions detected by the position sensors in the storage means in case that the torque control mode is selected by the selection means, and for driving the drive sources based on the positions stored in the storage means in case that position control mode is selected by the selection means.

* * * * *